United States Patent [19]

Berkowitz

[11] 4,144,003

[45] Mar. 13, 1979

[54] BAR TYPE SEAL FOR ROTARY MECHANISM

[75] Inventor: Murray Berkowitz, Woodcliff Lake, N.J.

[73] Assignee: Curtiss-Wright Corporation, Wood-Ridge, N.J.

[21] Appl. No.: 854,056

[22] Filed: Nov. 23, 1977

[51] Int. Cl.[2] ..... F01C 19/06

[52] U.S. Cl. ..... 418/113; 418/152

[58] Field of Search ..... 418/113, 122, 123, 124, 418/152, 178, 179

[56] References Cited

U.S. PATENT DOCUMENTS

| | | | |
|---|---|---|---|
| 3,113,526 | 12/1963 | Paschke | 418/122 X |
| 3,194,488 | 7/1965 | Fuhrmann | 418/113 |
| 3,235,171 | 2/1966 | Frenzel et al. | 418/122 X |
| 3,672,798 | 6/1972 | Scherenberg | 418/113 |
| 3,685,922 | 8/1972 | Lamm | 418/113 |
| 3,759,534 | 9/1973 | Sakamaki | 418/178 X |
| 3,820,798 | 6/1974 | Lamm | 418/179 X |
| 3,873,249 | 3/1975 | Rao | 418/113 |
| 3,909,310 | 9/1975 | Uy | 418/179 X |
| 3,985,477 | 10/1976 | Antrim et al. | 418/122 |

FOREIGN PATENT DOCUMENTS

| | | | |
|---|---|---|---|
| 1200081 | 9/1965 | Fed. Rep. of Germany | 418/113 |
| 2238370 | 2/1975 | France | 418/113 |
| 1078705 | 8/1967 | United Kingdom | 418/113 |

*Primary Examiner*—Carlton R. Croyle
*Assistant Examiner*—Leonard E. Smith
*Attorney, Agent, or Firm*—Arthur Frederick

[57] ABSTRACT

The bar seal for use in a rotary mechanism and which is disposed for sliding movement in a groove and to sealingly engage a surface, has an elongated base structure of high wear resistance characteristic and a body portion of a material having a low coefficient of friction connected to the base structure to form a unitary assembly. The body portion is dimensioned to extend a substantial part of the length of the base structure and of a width to form opposite planar surfaces for contacting the walls of the groove.

14 Claims, 14 Drawing Figures

FIG. 1
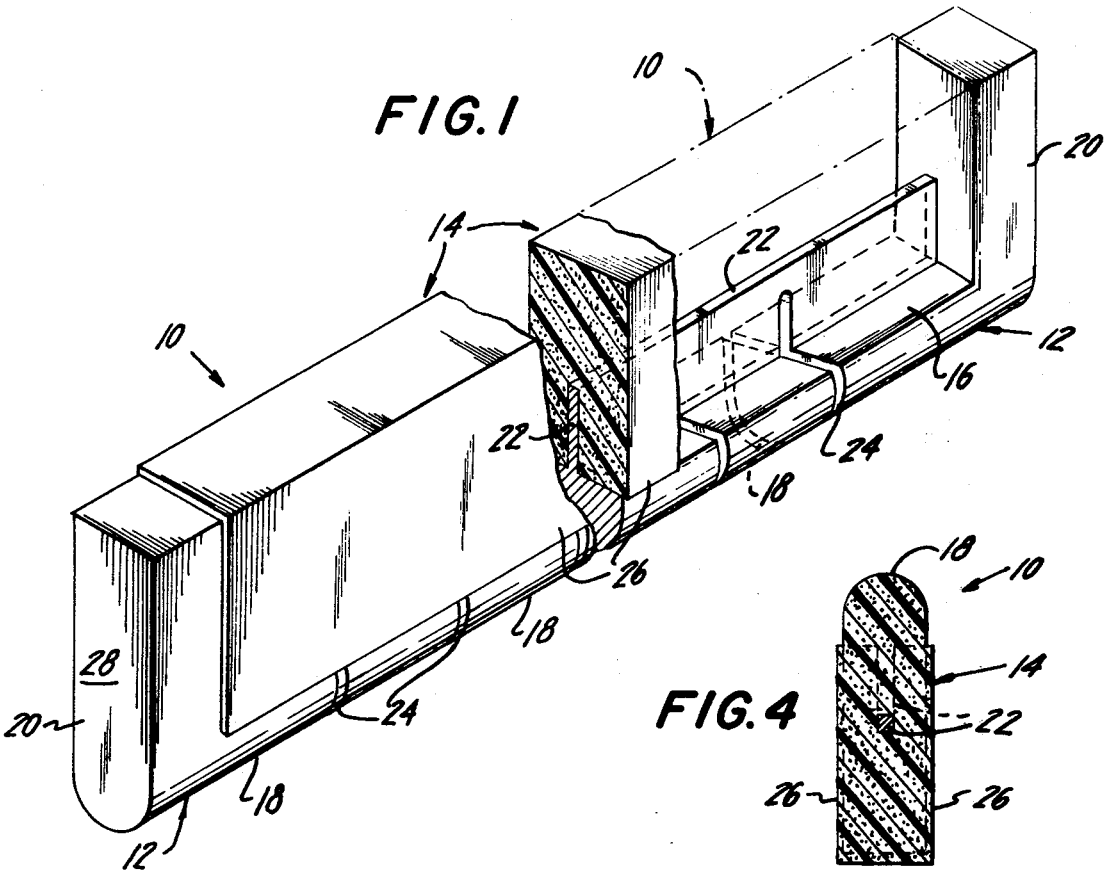
FIG. 4
FIG. 2
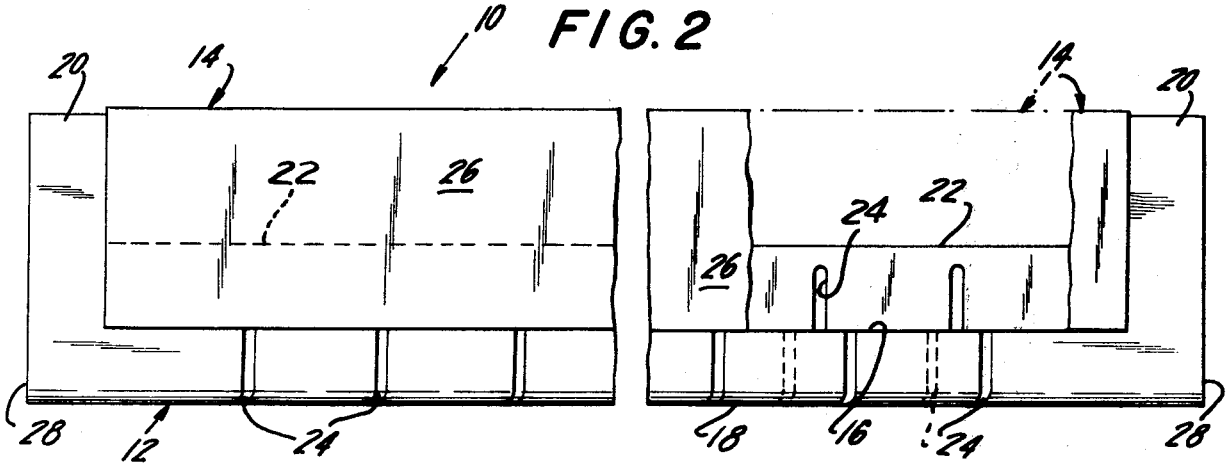
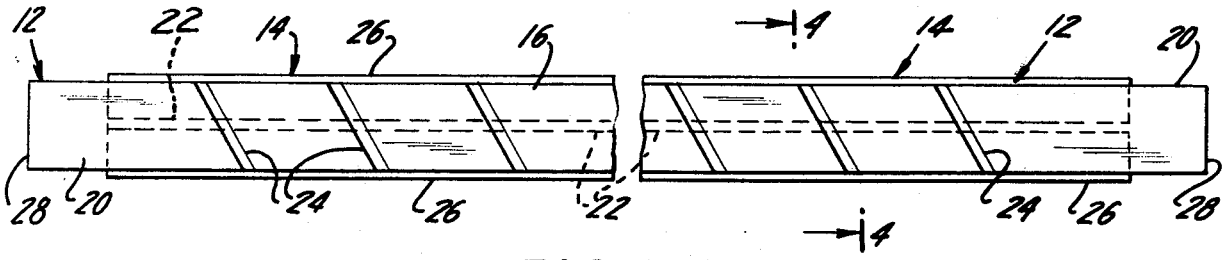
FIG. 3

FIG. 5
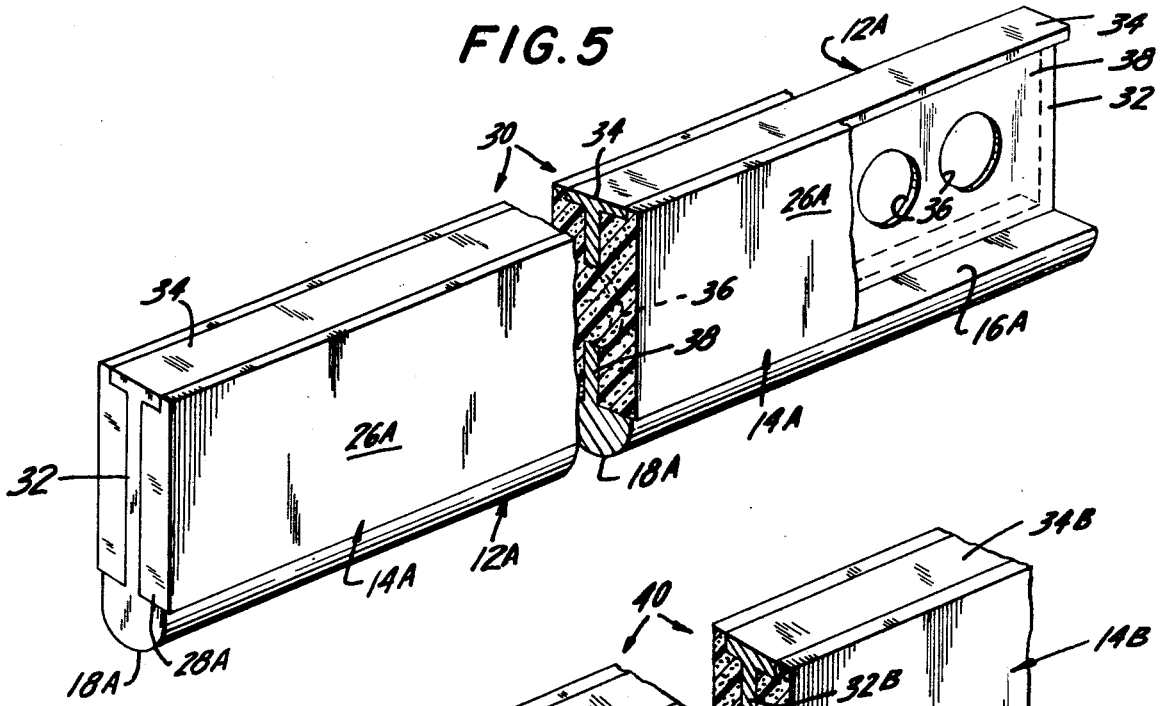
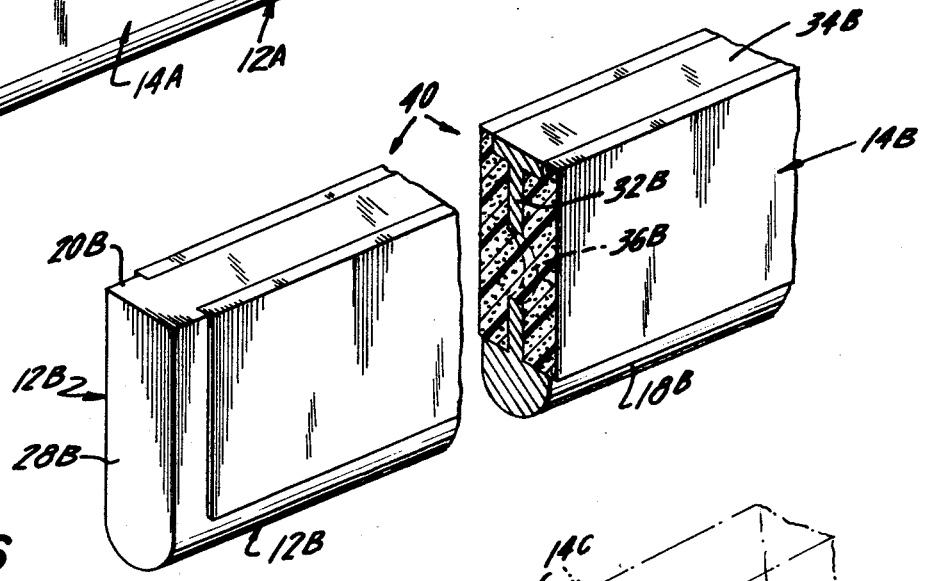
FIG. 6
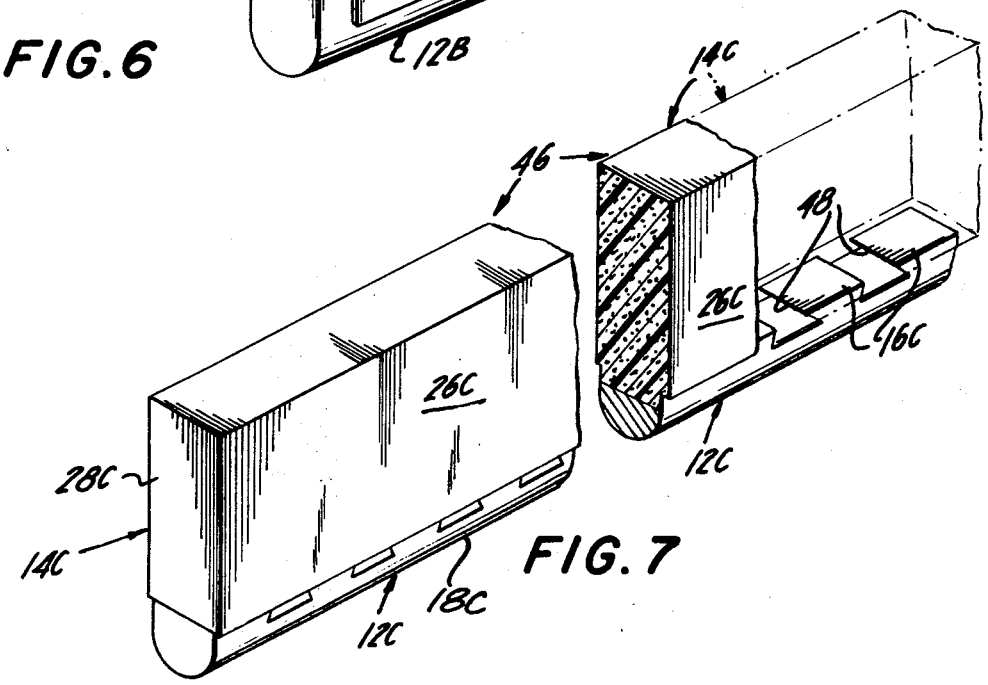
FIG. 7

FIG. 12
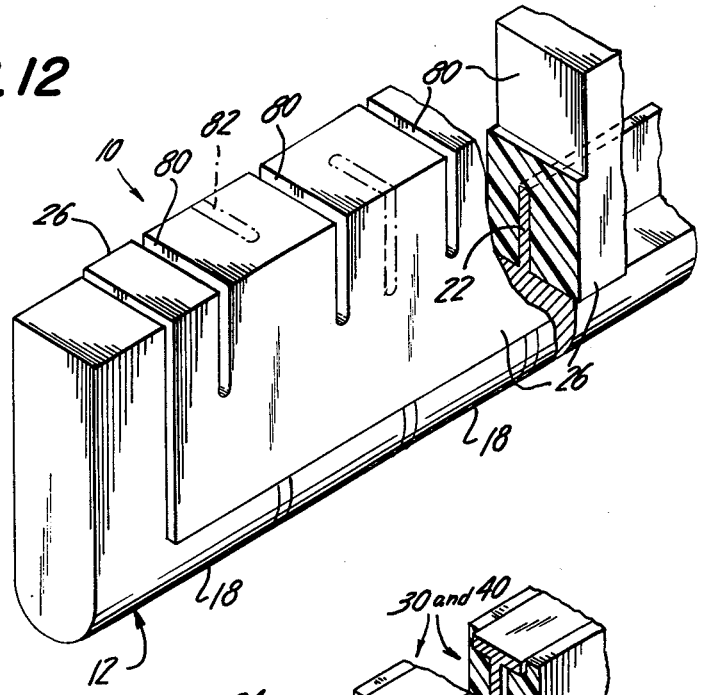
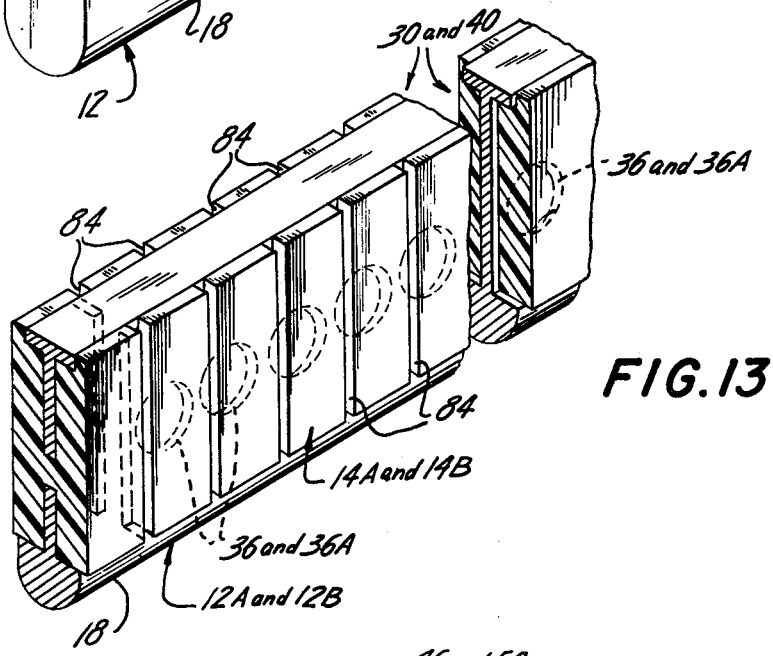
FIG. 13
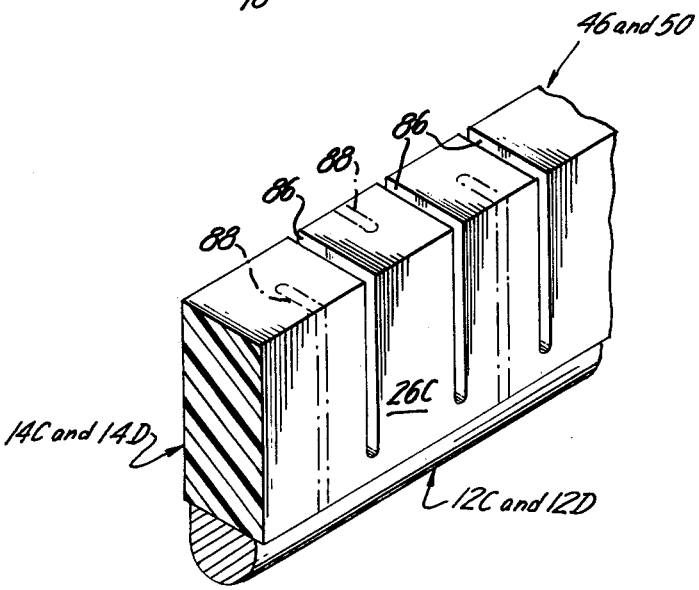
FIG. 14

BAR TYPE SEAL FOR ROTARY MECHANISM

This invention relates to seals for rotary mechanisms and, more particularly, to bar seals at the lobe junctures of rotary piston mechanisms having a housing cavity of multi-lobe, trochoidal configuration, or at the rotor apexes.

BACKGROUND OF THE INVENTION

In rotary mechanisms, such as pumps, engines and compressors, having a rotor eccentrically supported for planetary movement in a housing cavity of multi-lobe, trochoidal configuration, bar seals are provided at the lobe junctures or at the apex portions of the rotor. These bar seals in conjunction with other seals elements isolate the working chambers formed between the rotor and housing from each other and surrounding areas. The bar seals may be employed in rotary piston mechanisms having a housing of epitrochoidal or hypotrochoidal configuration, as exemplified in the Japanese Pat. No. 50527 dated 1972 to Kogyo, British Pat. No. 583,035 dated Dec. 5, 1946 to Maillard, and U.S. Pat. No. 3,990,239 dated Nov. 9, 1976 to Pattas et al. Each of the bar seals is disposed for sliding movement in a slot or groove in the housing or rotor. A reciprocative movement is unavoidable because of necessary bearing clearances, timing gear back-lash, thermally caused distortions of the housing and rotor, and manufacturing tolerances. While composite bar seals were known prior to this invention, as exemplified in the U.S. Patents to Lamm, No. 3,685,922 dated Aug. 22, 1972; Schereberg, No. 3,672,798 dated Aug. 27, 1972; Lamm, No. 3,820,798 dated June 28, 1974; Antrim et al, No. 3,985,477 dated Oct. 12, 1976 and Rao, No. 3,873,249 dated Mar. 25, 1975, they suffer from one or more of the disadvantages of being heavy, rigid, weak and/or binding in their associated grooves.

It is, therefore, desirable to provide a bar seal which will slide within its associated groove with a minimum of friction to thereby insure that the bar seal will maintain continuous sealing contact pressure. Also, it would be desirable, particularly in compressors, for such bar seals to require no lubrication so that the problems of oil contamination of the gas being compressed is obviated. It has further been found advantageous for bar seals to be light in weight and conform to the possible irregularity of the surface with which it contacts to insure sealing integrity.

Accordingly, it is an object of this invention to provide a bar seal for a rotary piston mechanism which maintains continuous sealing contact pressure.

Another object of the present invention is to provide a bar seal for a rotary piston mechanism which requires no lubrication. A further object is to provide a bar seal which is relatively light in weight, providing a short time response to allow the pressure to cause the seal to conform to the sealing surface.

A still further object of this invention is to provide a bar seal for a rotary piston compressor which is flexible so as to insure continuous sealing contact along its length by conforming to minor irregularities in the sealing surface. At the same time sufficient strength is required to bridge over openings such as peripheral ports.

A feature of this invention is a body of material having self-lubricating characteristics, as for example, polytetrafluoroethylene (known by the trademark "Teflon") which may be mixed with bronze or other similar materials or compositions, secured to and at least covering portions of a base structure of high wear resistance characteristics, the base structure providing the sealing wear surface. The base structure may consist of cast iron or other well-known seal blade material.

SUMMARY OF THE INVENTION

The present invention, therefore, contemplates a novel bar seal for a rotary mechanism having a housing which defines a multi-lobe cavity and in which cavity is supported a rotor for planetary rotation. The rotor defines with the housing a plurality of working chambers which expand and contract in volumetric size upon rotation of said rotor. The housing has intake and discharge ports for respectively receiving fluid into the working chambers and discharging fluid from the working chambers. A groove of substantially rectangular configuration is provided in the housing at each lobe juncture or in the rotor at its apex portions for receiving a bar seal, according to this invention, for reciprocative movement therein.

The bar seal comprises an elongated, relatively flexible base structure of material of high wear resistance characteristics. The base structure has an elongated portion of a width less than that of the groove in which it is disposed and has a sealing edge surface extending substantially its entire length. A body structure of a material having a low coefficient of friction and which may be relatively heat resistant is connected to said base structure to form a unitary assembly. The body structure is dimensioned to extend a substantial part of the length of the base structure and is of a width greater than the width of the elongated portion, but less than the width of the associated groove, to form opposite surfaces for contacting the walls of the groove. The body structure functions to minimize friction between the bar seal and its groove while the base structure functions to give strength to the unitary assembly as well as providing wear resistant sealing surfaces.

The base and body structures may be bonded together or otherwise suitably secured together. Such means for securing the structures together may include spaces associated with the base structure for receiving portions of the body structure to thereby anchor the structures together into a unitary assembly. In the event thermal differential expansion of the base and body structures is such as to excessively deform the bar seal, the body structure which would have the higher thermal coefficient of expansion, is provided with expansion slits or gaps.

BRIEF DESCRIPTION OF THE DRAWINGS

The invention will be more fully understood from the following detailed description thereof when considered in connection with the accompanying drawings wherein several embodiments of the invention are illustrated by way of example and in which:

FIG. 1 is a perspective view of a bar seal according to a first embodiments of the invention, with parts broken away for illustration purposes;

FIG. 2 is a side elevational view of the bar seal of FIG. 1 with parts broken away for illustrative purposes;

FIG. 3 is an end edge elevational view of the bar seal of FIGS. 1 and 2;

FIG. 4 is a cross-sectional view taken along line 4—4 of FIG. 3;

FIG. 5 is a view in perspective of a bar seal according to a second embodiment of this invention with parts broken away for illustrative purposes;

FIG. 6 is a fragmentary perspective view of a bar seal according to a third embodiment with parts thereof removed for illustration purposes;

FIG. 7 is a perspective view of a bar seal according to a fourth embodiment of the invention also with parts broken away for purposes of illustration;

FIGS. 12, 13 and 14 show expansion slits which may be provided in the bar seals of this invention to compensate for thermal differential expansion between the body and base structures.

DESCRIPTION OF THE PREFERRED EMBODIMENTS

Figure 8:
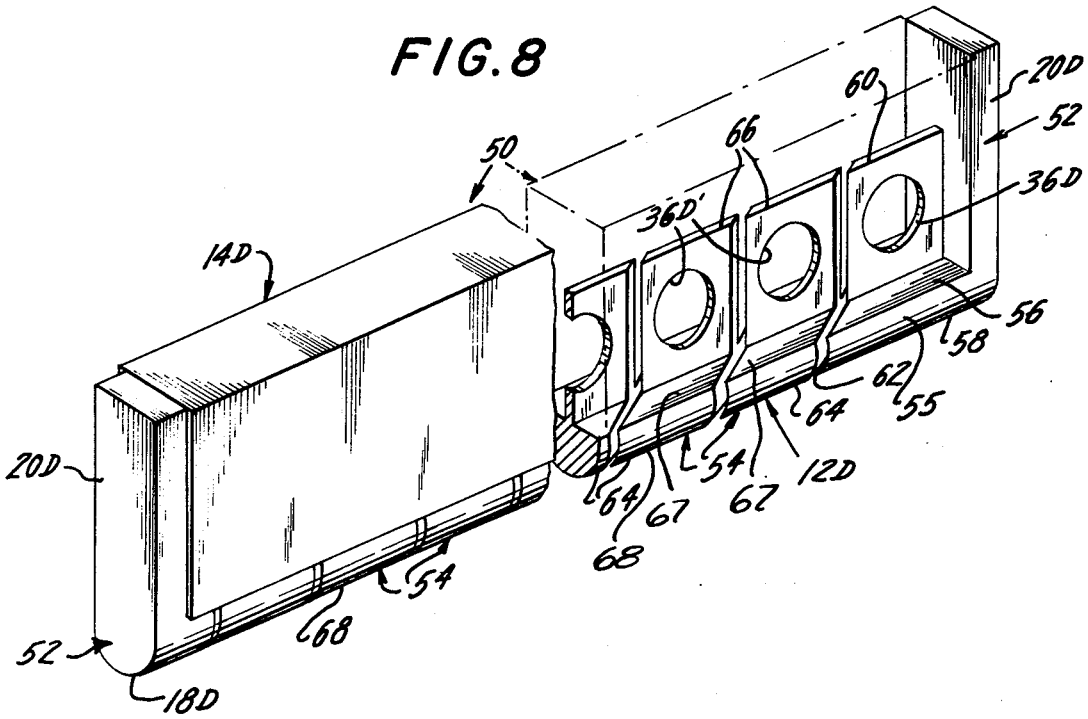
FIG. 8 is another view in perspective of a bar seal according to a fifth embodiment of the invention with parts removed for illustration purposes.

Now, referring to the drawings and, more particularly, to FIGS. 1 to 4, the reference number 10 generally refers to a bar seal, according to a first embodiment of this invention. The bar seal 10 comprises basically a base structure 12 and a body portion or structure 14 connected to the base structure to form a unitary assembly.

The base structure 12 is an elongated member fabricated from a high wear-resistant material, such as a cast iron known as Goetze IKA or other well-known seal material, as for example, sintered Clevite 300 produced by the Clevite Corporation; Ferro-Tic produced by the Sintercast Division of Chromalloy-American Corporation; Elnisil (SiC Ni) or the like. The base structure consists of an elongated portion having a planar surface 16 and an opposite, arcuate sealing edge surface 18. Integrally formed with the elongated portions are opposite end portions 20 extending normal to the longitudinal axis or length of the elongated portion. Also, integrally formed with the elongated portion and end portions 20 is a web or rib portion 22 extending between end portions 20 and in a plane normal to planar surface 16. A series of laterally spaced slots or grooves 24 are provided in base structure 12. Each of these grooves 24 extend inwardly from arcuate surface 18, through planar surface 16 and into rib portion 22, to a point short of the distal end edge of rib 22. The grooves 24 may be perpendicular to the longitudinal axis, but are preferably made to be canted relative to the longitudinal axis of base structure 12 so that in use of bar seal 10, the edges of the grooves 24 engage the contacting surface at different points along the length of the groove edges. This insures less wear and more uniform wear of the contacting surface.

The body portion or structures 14 comprises material of low coefficient of friction which is bonded as by casting or otherwise secured in a suitable manner to base structure 12 to form a unitary assembly. The body structure 14 may be made of any suitable heat-resistant, self-lubricating material, composition or alloy, as for example, bronze-filled polytetrafluoro-ethylene (known by the DuPont trademark "Teflon").

The body structure 14 is fabricated in such manner that material of body structure 14 occupies the grooves 24 of base structure 12, thereby interlocking body and base structures 12 and 14 together. The body structure 14 is dimensioned to extend between end portions 20 and is of a width greater than the width of planar surface 16 of base structure 12 but less than the width of the groove (not shown) in which the bar seal is disposed. The body structure 14 is formed so as to provide opposite, substantially parallel side surfaces 26 which engage the walls (not shown) of the associated groove (not shown) and guides as well as facilitates slidable movement of bar seal 10 relative to its associated groove.

The bar seal 10 has relative flexibility along its length by reason of grooves 24 and within the compressibility and stretchability of the material of the body structure lying within and outside of grooves 24. This flexibility permits the bar seal to conform to slight irregularities in the sealing (not shown) with which it is in contact. The bar seal 10 also provides a wear-resistant contacting surface 18 and end surfaces 28 where such high wear resistance is required. Furthermore, the low coefficient of friction or self-lubricating characteristic of the material of body structure 14 permits the bar seal to freely move within its associated groove without binding and thereby insuring the maintenance of the desired sealing contact pressure.

In FIG. 5 is shown a bar seal 30, according to a second embodiment of the present invention, which is also a composite seal and differs from bar seal 10 of FIGS. 1 to 4 principally in that the base structure is of different configuration from base structure 12 of bar seal 10. Parts of bar seal 30, corresponding to like parts of bar seal 10, will be designated by the same reference number but with a suffix A added thereto.

The bar seal 30 has a base structure 12A which, similar to base structure 12, is an elongated member having a planar surface 16A, an opposite, arcuate sealing edge surface 18A and an integral rib portion 12. This rib portion 32 is "T" shaped in cross-section with its cross leg 34 being coextensive with and parallel to surface 16A. A plurality of longitudinally spaced holes 36 are provided in the vertical leg portion 38 of rib portion 32. A body structure 14A, similar to body structure 14 of FIGS. 1 to 4, is secured to base structure 12A by casting, and the like, as previously discussed with respect to bar seal 10. The material of body structure 14A fills holes 36 to thereby anchor the body structure to base structure 12A. The body structure 14A extends the full length of base structure 12A and is of a width greater than planar surface 16A, but less than that of the groove (not shown) within which the bar seal 30 is disposed. Thus, bar seal 30 is provided, similar to bar seal 10, with parallel side surfaces 26A or low coefficient material. Since body structure 14A is coextensive with base structure 12A, the opposite end surfaces 28A are a combination of base and body structures to provide both low rubbing friction and high wear resistance.

In FIG. 6 is shown a bar seal 40, according to a third embodiment of this invention, which is similar to bar seal 30, and only differs from bar seal 30 in that the base structure has end portions similar to those of base structure 12 of bar seal 10. In view of the similarities of the bar seals 10, 30 and 40, the parts of bar seal 40 will be designated by the same number as the parts of bar seals 10 and 30, but with the suffix B added thereto.

As shown in FIG. 6, base structure 12B has integral thereto, end portions 20B extending normal to the longitudinal axis of the bar seal assembly. This construction provides a bar seal where each of the end surfaces 28B is entirely of wear-resistant material rather than, as in bar seal 30, of both low coefficient of friction material and high wear-resistant material. The remaining features of bar seal 40 are the same as those of bar seals 10 and 30.

In FIG. 7 is shown a bar seal 46, according to a fourth embodiment of the present invention. Bar seal 46 differs from bar seals 10, 30 and 40 in that the base structure is again different from the base structures 12, 12A and 12B of bar seals 10, 30 and 40, respectively. Again parts of bar seals 10, 30 and 40 will be identified by the same number but with the suffix C added thereto.

As illustrated, bar seal 46 has a base structure 12C which has a plurality of spaced grooves 48 in planar surface 16C of the base structure. The grooves 48 are of the dovetail-type and receive therein material of body structure 14C. The body structure 14C is suitably attached to base structure 12C as previously described with respect to bar seal 10. The body structure provides opposite side surfaces 26C, similar to side surfaces 26 and 26A of bar seals 10 and 30, and end bearing surfaces 28C which are entirely of material of low coefficient of friction.

In FIGS. 8 to 11 is a bar seal 50, according to a fifth embodiment of this invention. The bar seal 50 is similar to bar seal 10 and basically differs from bar seal 10 in that the base structure is made up of a plurality of sections instead of being of one piece construction. In view of the similarities of bar seals 10 and 50, parts of bar seal 50 corresponding to like parts of bar seal 10 will be designated by the same number but with the suffix D added thereto.

As best shown in FIG. 8, bar seal 50 has a base structure 12D which comprises two spaced end sections 52 and a plurality of intermediate sections 54 disposed end-to-end between end sections 52.

Each end section 52 has a portion 55 having a planar surface 56 and an opposite, arcuate-shaped surface 58. Each end section 52 also has an integral end element 20D extending normal to surface 56 corresponding to end portion 20 of bar seal 10. A web or rib 60 extends normal to planar surface 56 and between end element 20D and the planar surface. This rib 60 is provided with a hole 36D therein, similar to holes 36 of bar seal 30 shown in FIG. 5. The end 62 of each portion 55 has a cant relative to its longitudinal axis.

Figure 9:
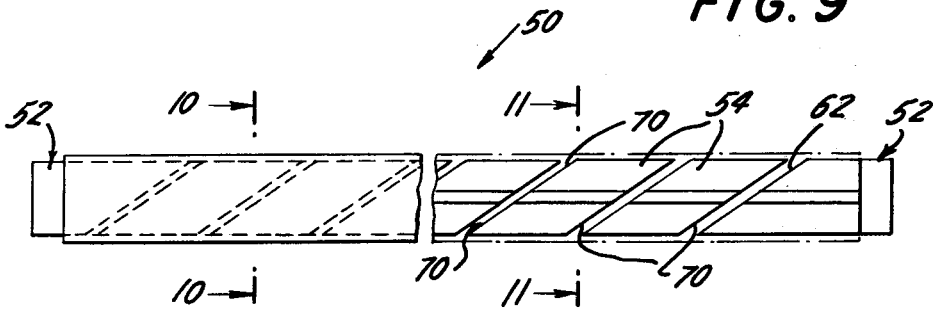
FIG. 9 is an elevational view of the anti-sealing end edge of the bar seal of FIG. 8 with a portion thereof removed for illustration purposes.
Figure 10:
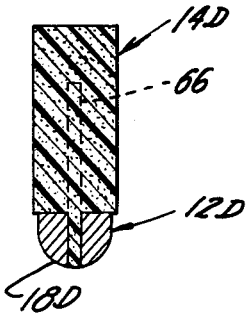
FIGS. 10 and 11 are cross-sectional views taken respectively along lines 10—10 and 11—11 of FIG. 9.
Figure 11:
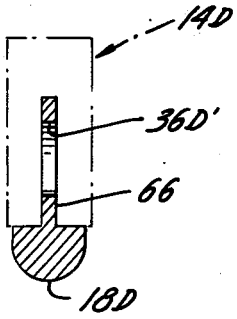

Each of the intermediate sections 54 have a portion 64 having a planar surface 67 and an opposite, arcuate surface 68, similar to surfaces 56 and 58 of end sections 52, and having the same size and cross-sectional configuration of end sections 52. Also, each intermediate section 54 has a rib extending normal to the surface 66 and of substantially the same size as ribs 60 of end sections 52. Each of the ribs 60 has an opening 36D', similar to holes 36D. The opposite ends 70 of each of the intermediate sections 54 are canted with respect to the longitudinal axis thereof so that in elevational plan view, as shown in FIG. 9, sections 54 have a parallelogram configuration.

In the fabrication of bar seal 50, the sections 54 are arranged in end-to-end relationship between end sections 52 with the ribs 60 and each section spaced from the next adjacent section and with the ribs 60 and 66 lying in alignment and in a common plane. The body structure 14D, similar to body structure 14, is cast to base structure 12D while sections 52 and 54 are held as by a jig or the like, in the desired spaced relationship to each other. The material of body structure 14D flows into holes or openings 36D and 36D' of ribs 60 and 66 and into the spaces between sections 52 and 54. The material of body structure 14D thus functions to secure the sections 52 and 54 together and thereby forms a unitary assembly.

The dimensional relationship of base and body structures 12D and 14D is the same as described with respect to bar seal 10. The bar seal 50 of this embodiment also has the functional characteristics of slidability in its supporting groove, resistance to wear, light in weight and has relative flexibility.

It is recognized that the various combination of materials which may be selected for the base structures 12, 12A, 12B, 12C and 12D and body structures 14, 14A, 14B, 14C and 14D will have different thermal coefficients of expansion and that the material of the body structures will have a higher coefficient of expansion than the material of the associated base structure. Therefore, to avoid jamming, the composite bar seals of this invention must be dimensioned to provide assembly clearances greater than are provided for conventional bar seals for rotary combustion engines of the Wankel type. These assembly clearances are the spaces between the bar seal and its associated groove and the ends of the bar seal and the adjacent housing end walls. Some self-compensation is automatic since the wear resistant sealing edge surface 18, 18A, 18B, 18C and 18D, having the lower coefficient of expansion, reaches higher temperatures due to the friction between it and the adjacent housing surface. Any tendency for the bar seal to arch under differential thermal expansion is compensated for by the inherent flexibility of the bar seal and the pressure load which forces the bar seal into contact with the sealing surface.

As shown in FIGS. 12, 13 and 14, the bar seals 10, 30, 40, 46 and 50 may be provided with slits to permit greater expansion of their respective body structures to occur without excessive deformation of the bar seals.

In FIG. 12 the bar seal 10 is shown as having in the body structure 14 a plurality of spaced through-slits 80 to compensate for the differential expansion between body structure 14 and base structure 12. Alternatively, where leakage may occur across the width of the bar seal through slits 80, a plurality of spaced blind-slits 82 (shown in broken lines) may be provided in one side surface 26 and terminating short of the other side surface 26.

In FIG. 13 the bar seals 30 and 40 may be provided with expansion joints in the form of a plurality of spaced slits 84 which extend the full length of body structures 14A and 14B and inwardly in a plane extending between the holes 36 and 36B of their respective base structures 12A and 12B.

In FIG. 14, the bar seals 46 and 50 may be provided with expansion gaps in the form of a plurality of spaced slits 86 which extend transversely of body structures 14C and 14D to a point short of their respective base structures 12C and 12D. In the alternative as shown in broken lines in FIG. 14, slits 88, similar to slits 82 in the embodiment of FIG. 12, may be provided. These slits 88 extend from one side of the body structure to a point short of the other side of the body structure so that no continuous leakage path from one side of the seal to the other is provided.

It is now believed apparent that the present invention provides a bar seal in which sealing pressure will be maintained by obviating binding in its associated slot. It is a bar seal which is relatively light in weight and has the desired flexibility to conform to the slight irregularities of the sealing surface with which it is in contact.

Although several embodiments of the invention have been illustrated and described in detail, it is to be expressly understood that the invention is not limited thereto. Various changes can be made in the arrangement of parts without departing from the spirit and scope of the invention as the same will now be understood by those skilled in the art.

What is claimed is:

1. A bar seal for use in a rotary mechanism having a housing defining a multi-lobe cavity in which cavity a rotor is supported for planetary rotation relative to the housing and defines with the housing a plurality of working chambers which expand and contract in volumetric size upon rotation of said rotor and which mechanism has intake and discharge ports for respectively receiving fluid into the working chambers and discharging fluid from the working chambers, the bar seal being disposed for reciprocative movement in a groove and comprises:

a) an elongated base structure of high wear-resistance characteristics, having a sealing edge surface extending substantially its entire length, b) a body structure of a material having a low coefficient of friction connected to said base structure to form a unitary assembly and dimensioned to extend a substantial part of the length of the base structure and of a width to form opposite planar surfaces for contacting the walls of said groove, and c) a plurality of longitudinally separated gaps extending generally transversely of the length of the base structure for receiving therein portions of said body structure and forming thereby a series of joints interlocking said base and body structures together and providing longitudinal flexibility of the assembly.

2. The apparatus of claim 1 wherein the body portion is provided with a plurality of slits for allowing for differential expansion between the body portion and base structure.

3. The apparatus of claim 1 wherein said interlocking joints are of the dovetail-type.

4. The apparatus of claim 1 wherein said base structure has end portions projecting substantially perpendicularly from said sealing edge surface and substantially the full distance of the end portions of the body structure for contact with the housing.

5. The apparatus of claim 1 wherein said base structure comprises a plurality of separate sections disposed in close, spaced aligned relationship to each other to form said gaps and held together by portions of the body in the gaps between the sections.

6. A bar seal for a rotary mechanism having a housing defining a multi-lobe cavity in which a rotor is supported for planetary rotation relative to the housing and defines with the housing a plurality of working chambers which expand and contract in volumetric size upon rotation of said rotor and which housing has intake and discharge ports for respectively receiving fluid into the working chambers and discharging fluid from the working chambers, a groove of substantially rectangular configuration being provided in the housing at each lobe juncture or in the rotor periphery for receiving a bar seal for reciprocative movement therein, the bar seal comprising:

a) an elongated base structure of material of high wear-resistance characteristic;

b) said base structure having an elongated portion of a width less than that of the groove in which it is disposed and having a sealing edge surface extending substantially its entire length;

c) a body structure of a material having a low coefficient of friction connected to said base structure to form a unitary assembly and dimensioned to extend a substantial part of the length of the base structure and of a width greater than the width of the elongated portion but less than the associated groove to form opposite surfaces for contacting the walls of said groove; and d) a plurality of longitudinally separated spaces associated with the base structure and extending generally transversely thereof for receiving portions of the body structure to thereby form a series of joints for anchoring the latter to the base structure and provide longitudinal flexibility of the assembly.

7. The bar seal of claim 6 wherein the interlocking joints are of the dovetail-type.

8. The bar seal of claim 6 wherein said base structure comprises a plurality of separate spaced members.

9. The bar seal of claim 6 wherein said base structure has end portions projecting substantially perpendicularly to said elongated portion on the side opposite from the sealing edge surface, said body structure being disposed between said end portions.

10. The bar seal of claim 6 wherein said elongated portion of the base structure has a series of spaced slots extending inwardly from the sealing edge surface.

11. The bar seal of claim 6 wherein the base structure has a rib portion extending longitudinally of the elongated portion on a side opposite from the sealing edge surface and wherein a series of spaced slots are provided which extend inwardly from the sealing edge surface and into the rib portion.

12. The bar seal of claim 11 wherein said slots extend at an angle to the longitudinal axis of the base structure.

13. The method of producing a bear seal disposed for reciprocative movement in a groove for a rotary mechanism having a housing defining a multi-lobe cavity in which a rotor is supported for planetary rotation relative to the housing and defines with the housing a plurality of working chambers which expand and contract in volumetric size upon rotation of the rotor, the steps comprising:

a) forming out of material having high wear-resistance characteristics, a base structure having an elongated portion of a width less than that of the associated groove and a sealing edge surface on one side extending substantially the entire length of the elongated portion;

b) forming openings in the base structure; and c) casting material of low coefficient of friction to the base structure so that the material enters said openings to thereby be anchored to the base structure and dimensioned so as to extend a substantial part of the length of the base structure and of a width greater than the elongated portion but less than the groove.

14. The method of claim 13 wherein said material of low coefficient of friction is a mixture of bronze and plastic resin.

* * * * *